US006296133B1

(12) United States Patent
Cobane

(10) Patent No.: US 6,296,133 B1
(45) Date of Patent: Oct. 2, 2001

(54) CONTAINER FOR VINYL SIDING

(75) Inventor: Joseph L. Cobane, 759 Berkshire Rd., Grosse Pointe Park, MI (US) 48230

(73) Assignee: Joseph L. Cobane, Grosse Pointe Park, MI (US)

( * ) Notice: Subject to any disclaimer, the term of this patent is extended or adjusted under 35 U.S.C. 154(b) by 0 days.

(21) Appl. No.: 09/707,517

(22) Filed: Nov. 7, 2000

Related U.S. Application Data

(60) Provisional application No. 60/208,892, filed on Jun. 2, 2000.

(51) Int. Cl.[7] ..... B65D 6/18

(52) U.S. Cl. ..... 220/6; 220/1.5; 220/507; 220/9.4; 220/4.75; 206/321

(58) Field of Search ..... 220/1.5, 1.6, 6, 220/7, 4.28, 507, 504, 529, 4.26, 9.4, 475; 206/321

(56) References Cited

U.S. PATENT DOCUMENTS

| | | | | |
|---|---|---|---|---|
| 2,340,422 | * | 2/1944 | Okonski | 206/321 |
| 2,369,487 | | 2/1945 | Ochiltree . | |
| 3,195,723 | | 7/1965 | Mac Donnell et al. . | |
| 3,415,367 | | 12/1968 | Lynch . | |
| 3,915,298 | | 10/1975 | Adams et al. . | |
| 4,007,833 | | 2/1977 | Bigelow, Jr. . | |
| 4,375,848 | | 3/1983 | Simpson et al. . | |
| 4,506,798 | | 3/1985 | Goutille . | |
| 4,640,412 | | 2/1987 | Skvaril . | |
| 4,807,410 | | 2/1989 | Skvaril . | |
| 5,351,827 | | 10/1994 | Baka . | |
| 5,381,915 | | 1/1995 | Yardley . | |
| 5,516,244 | | 5/1996 | Baka . | |
| 5,609,111 | | 3/1997 | Hasegawa et al. . | |
| 5,722,550 | | 3/1998 | Ficker . | |
| 5,725,118 | * | 3/1998 | Slager et al. | 220/1.5 |
| 5,730,281 | | 3/1998 | Powell et al. . | |
| 5,862,912 | | 1/1999 | Schelhorn . | |

* cited by examiner

*Primary Examiner*—Stephen Castellano
(74) *Attorney, Agent, or Firm*—Reising, Ethington, Barnes, Kisselle, Learman & McCulloch, P.C.

(57) ABSTRACT

A container for bulk material such as siding panels has a plurality of upright posts mounted in stanchions along opposite sides of a base. Tubular cells extend lengthwise of the base between the posts. Cross rods are supported by the posts. The cells are suspended from the cross rods by hanger straps. The posts are pivoted to the stanchions so that the posts may be collapsed to horizontal positions. The cells when empty are also collapsible.

18 Claims, 7 Drawing Sheets

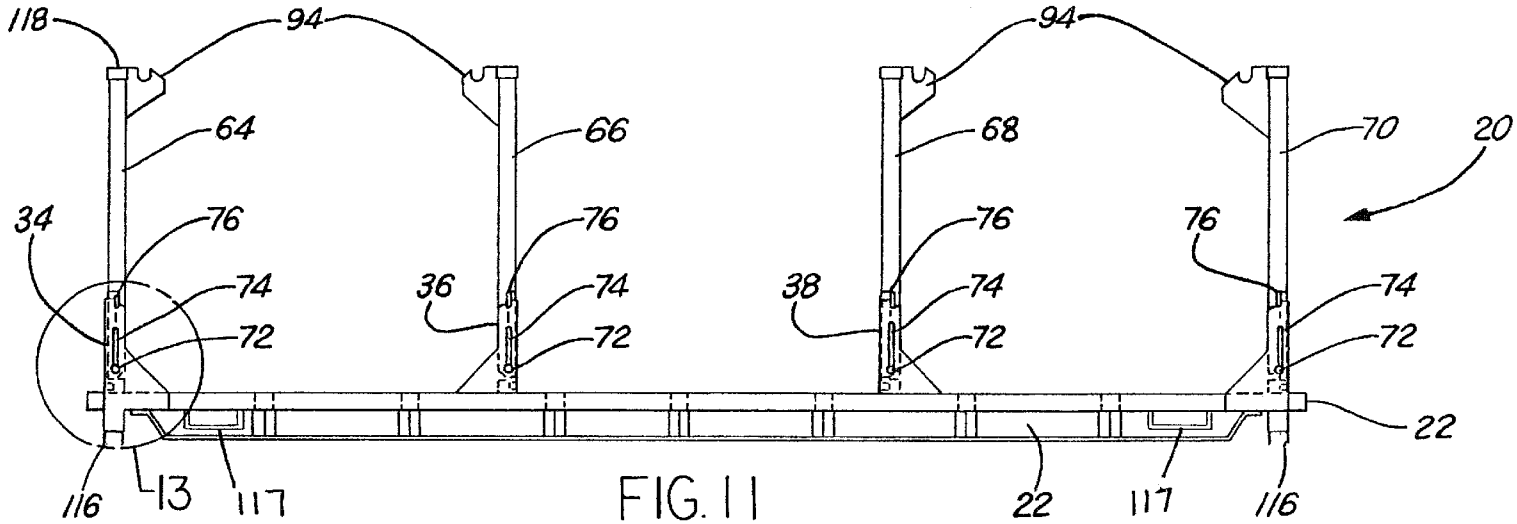
FIG. 11
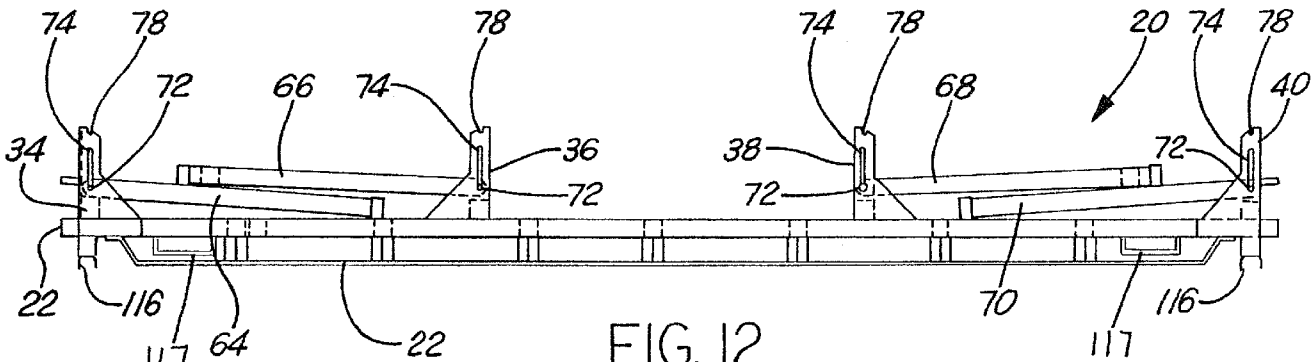
FIG. 12
FIG. 13
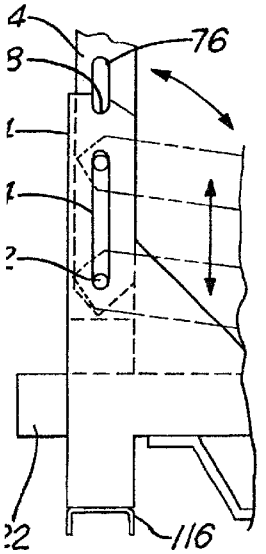

CONTAINER FOR VINYL SIDING

This application is based on my provisional application Ser. No. 60/208,892 filed Jun. 2, 2000.

FIELD OF THE INVENTION

This invention relates to a container for bulk material such as siding panels which may be made of vinyl and are intended for use as a covering for the sides of a house to simulate ordinary wood siding. Preferably, although not necessarily, the container is collapsible for return and reloading.

BACKGROUND AND SUMMARY OF THE INVENTION

Siding panels in the past have been arranged in small stacks and then placed in large corrugated boxes. Stacks of the cardboard boxes are unitized together, using corrugated or wooden framing members to form crates, for shipment. These framing members and even the corrugated boxes are used only once and then thrown away, resulting in a serious disposal problem. New boxes and new framing members are needed for each shipment, adding greatly to the cost of shipping.

The container of the present invention can handle a much greater supply of siding panels. Also, if can be used over and over again rather than thrown away after each use. When empty, the container of this invention can be collapsed to a relatively small size for return to the place where the siding panels are manufactured.

In accordance with a specific embodiment of this invention, the container comprises an elongated base having support means on opposite sides thereof extending upwardly from the base. Preferably the support means are in the form of posts in generally upright positions and in spaced apart relation along opposite sides of the base. The posts are preferably disposed in laterally spaced pairs with the posts of each pair on opposite sides of the base. A plurality of open-ended, tubular cells extend lengthwise of the base between the posts of each pair for receiving and supporting the bulk material. Cross rods are supported by the posts of each pair and the cells are suspended from the cross rods preferably by flexible hanger straps.

Preferably the posts are supported by stanchions for movement from their generally upright positions to collapsed positions folded downwardly on the base. In the collapsed position, the container is more easily returned to the place where the siding panels are manufactured.

One object of this invention is to provide a collapsible container having the foregoing features and capabilities.

Another object of the invention is to provide a collapsible container which is rugged and durable in use, is relatively inexpensive, and can be easily loaded and unloaded.

These and other objects, features and advantages of the invention will become more apparent as the following description proceeds, especially when considered with the accompanying claims and drawings.

BRIEF DESCRIPTION OF THE DRAWINGS

FIG. 11 is a side view of the container with the cells of the container omitted.

FIG. 12 is a view similar to FIG. 11 but showing the posts of the container in a collapsed position.

FIG. 13 is an enlarged view of the structure shown within the circle 13 in FIG. 11.

DETAILED DESCRIPTION OF THE PREFERRED EMBODIMENT

Figure 1:
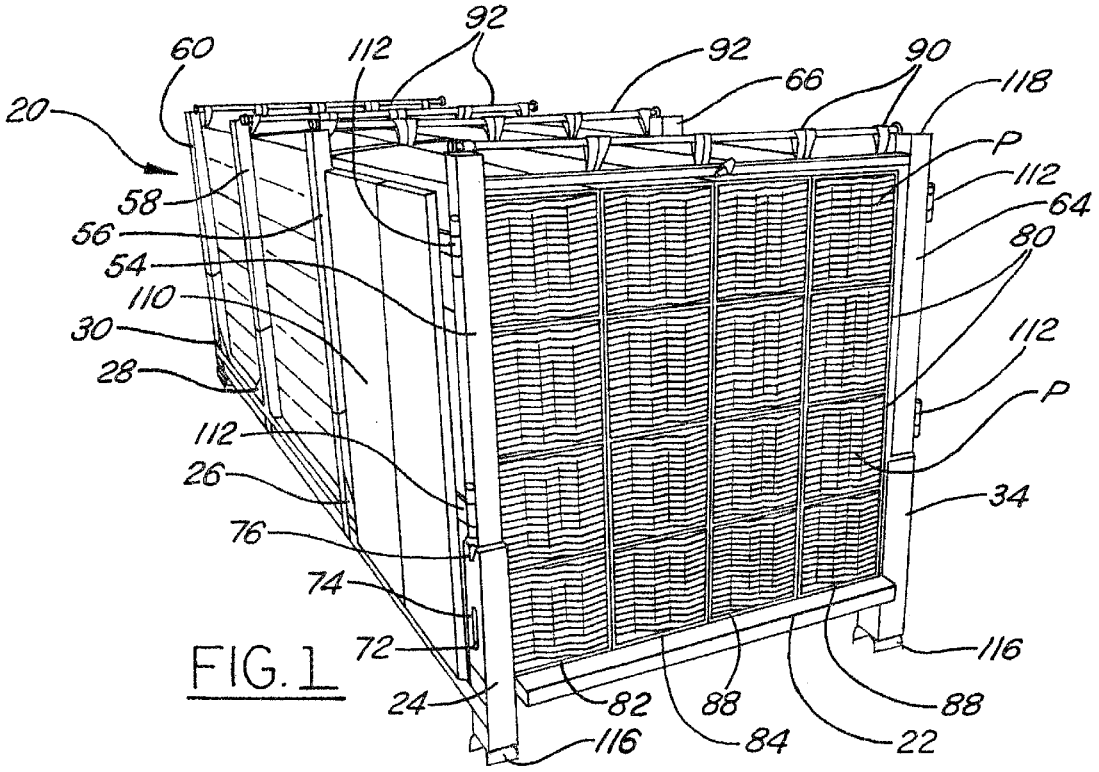
FIG. 1 is a perspective view of a container constructed in accordance with the invention, shown loaded with siding panels.
Figure 2:
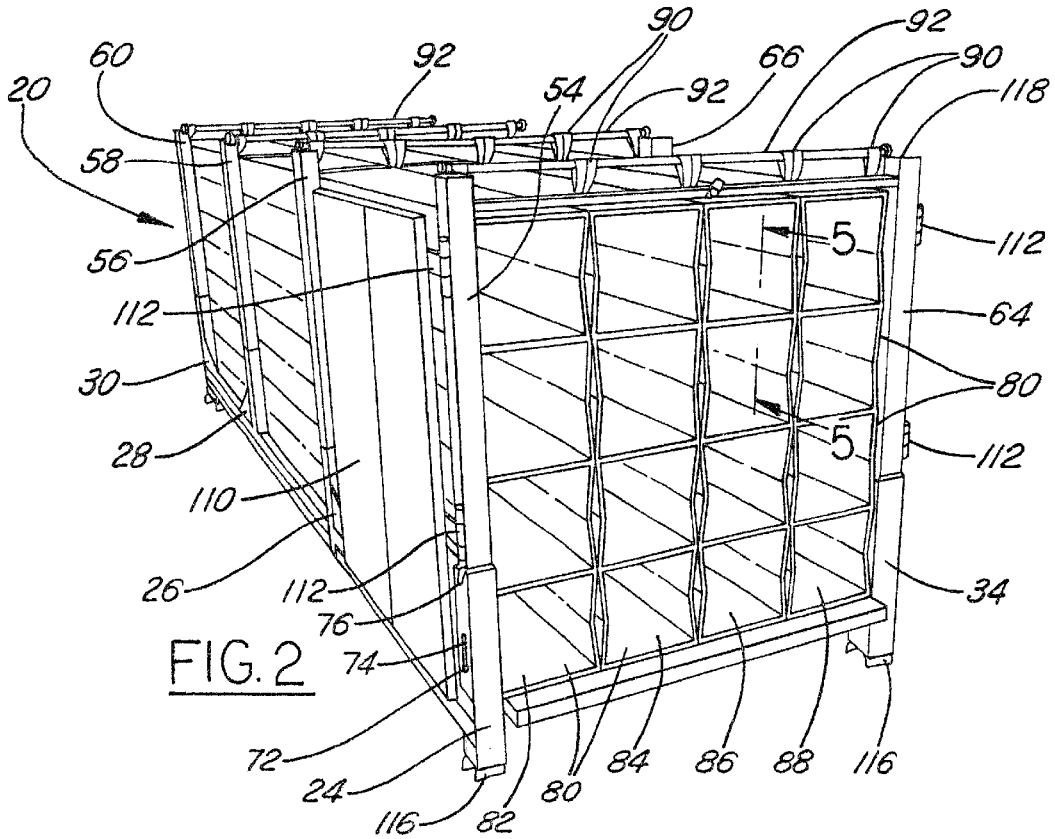
FIG. 2 is a view similar to FIG. 1 but with the siding panels removed.

Referring now more particularly to the drawings, and especially to FIGS. 1–13, a container 20 has an elongated rectangular, horizontal bottom or base 22. Along one side of the base 22 are four longitudinally spaced stanchions 24, 26, 28 and 30. Along the opposite side of the base 22 are longitudinally spaced stanchions 34, 36, 38 and 40. The stanchions 24, 30, 34 and 40 are at the four corners of the container. The stanchions on one side of the container are directly opposite those on the other side so that there are four pairs of stanchions, pair 24, 34, pair 26, 36 and pair 28, 38, and pair 30, 40, with the stanchions of each pair on opposite sides of the base.

Each stanchion is rigidly secured to the base 22 and is in the form of a vertically upright channel. On one side of the container, the end channel 24 and intermediate channel 26, as well as the end channel 30 and intermediate channel 28, have their open sides facing one another. On the other side of the container, the end channel 34 and intermediate channel 36, as well as the end channel 40 and intermediate channel 38, have their open sides facing one another.

A post is telescoped in each stanchion and normally extends vertically upwardly. The posts on one side of the container are designated 54, 56, 58 and 60 with the post 54 telescoped in the stanchion 24, the post 56 telescoped in the stanchion 26, the post 58 telescoped in the stanchion 28, and the post 60 telescoped in the channel 30. The posts on the opposite side of the container are designated 64, 66, 68, and 70, with the post 64 telescoped in the stanchion 34, the post 66 telescoped in the stanchion 36, the post 68 telescoped in the stanchion 38, and the post 70 telescoped in the stanchion 40.

Each post has a laterally outwardly projecting pin 72 slidable in an elongated vertical slot 74 in the associated stanchion (see FIGS. 2 and 11–13). The pin and slot connection permits each post to be raised far enough so that it can be pivoted to a horizontal position when the container is empty (see FIGS. 9, 10 and 12). When lowered to a fully telescoped position in the associated stanchion, each post is held erect in a vertical position by the stanchion. In this lowered position, a second pin 76 projecting laterally outwardly from each post extends into a notch 78 at the upper end of the associated stanchion to determined the lowered position. The engagement of the pin 76 of each post in the notch 78 of the associated stanchion holds the post upright so that it cannot pivot to the collapsed horizontal position.

The container 20 has a plurality of elongated, open-ended tubular sleeves or cells 80. Each cell extends the full length of the container and is adapted to hold a stack of elongated strips of relatively rigid material. The strips in this instance are vinyl siding panels and/or soffits P used to cover the exterior of a house to simulate ordinary wood siding. The panels may be about 10" wide and 12' long.

The cells 80 are preferably made of a suitable flexible plastic material. The side walls of each cell have "living" hinges 81 to permit the side walls to fold inwardly to permit the cells to collapse when empty. When filled with siding panels P, the cells are open and generally rectangular in cross section. The cells extend lengthwise of the container above the base and between the two rows of posts on either side of the container. In this instance there are four vertical stacks of cells arranged side-by-side, with four cells in each stack. The four stacks are designated 82, 84, 86 and 88.

Figure 5A:
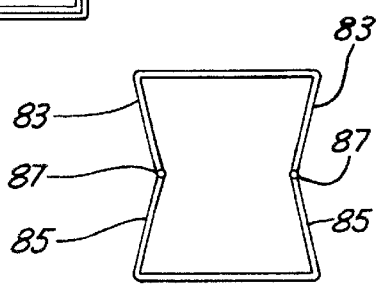
FIG. 5A is a sectional view showing a cell of modified construction.

FIG. 5A shows a cell of modified construction in which the side walls are made of upper and lower sections 83 and 85 having their adjacent edges pivoted to one another by a hinge pin 87 in the manner of a piano hinge.

Each stack of cells is supported by four flexible hanger straps 90. The straps are suspended from four cross rods 92. A cross rod 92 is removably supported on the upper ends of each pair of posts, in a bracket 94 (see FIG. 7). Each bracket 94 preferably is in the form of an upwardly facing semi-circular groove providing a receptacle to receive and support a cross rod.

Figure 6:
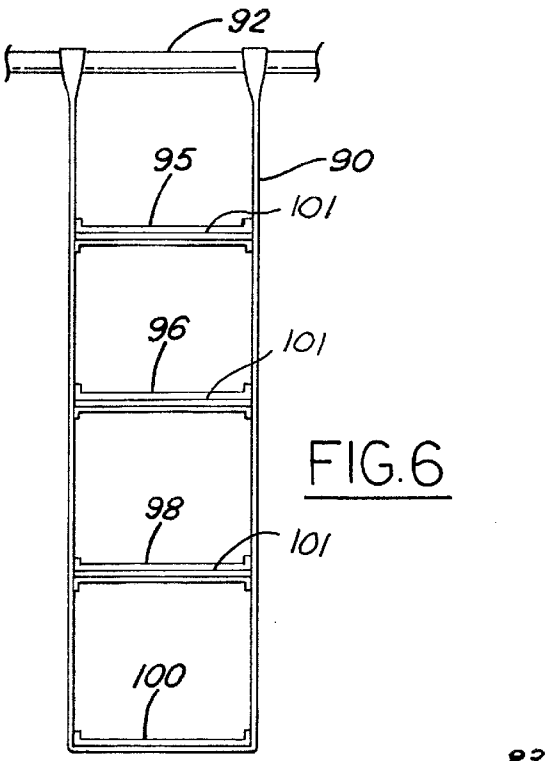
FIG. 6 is a fragmentary view showing one of the straps for supporting the cells, suspended from one of the cross bars. The strap in FIG. 6 is modified somewhat from the straps in FIG. 5, but only in that all of the cross strap portions thereof, except the bottom one, are specially reinforced.
Figure 5:
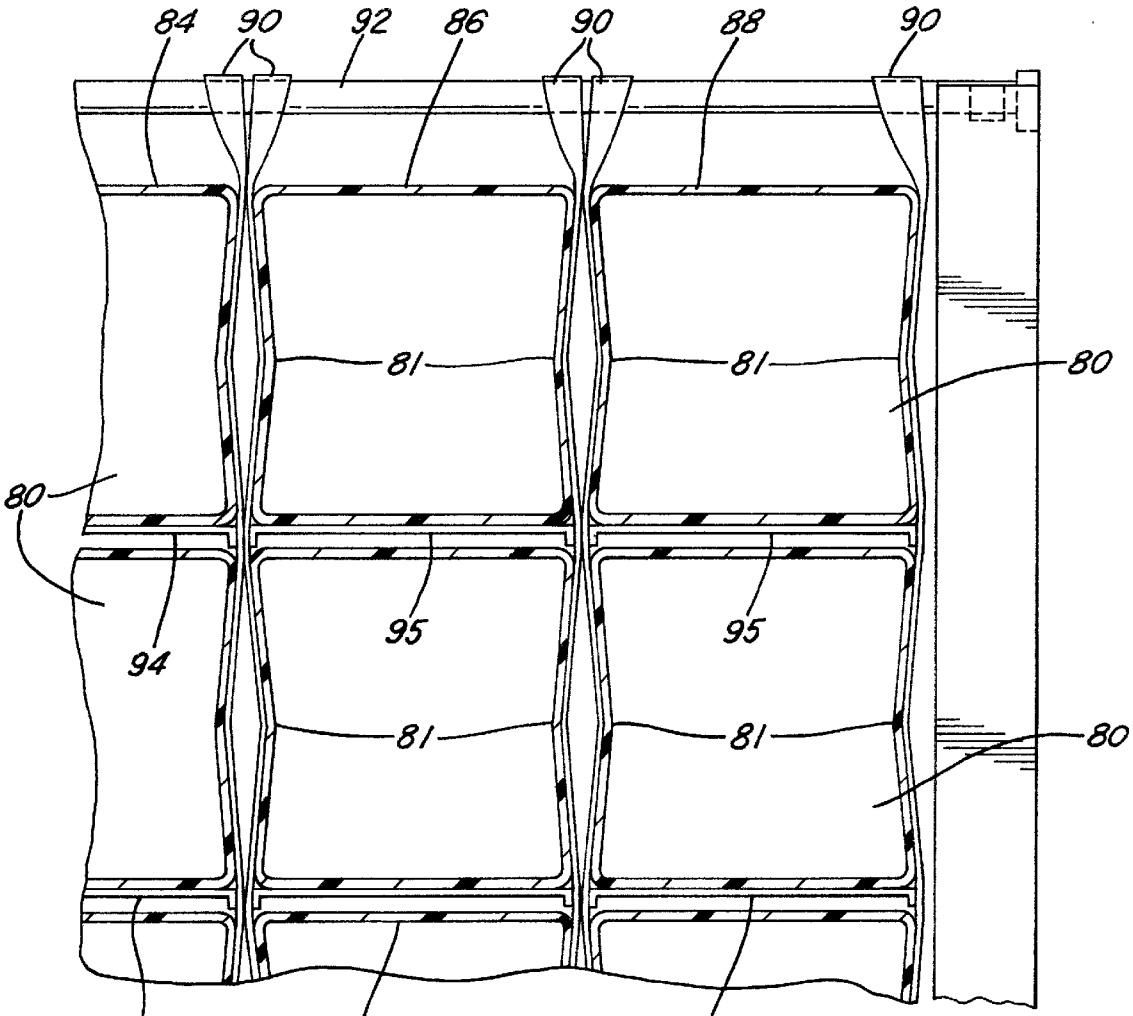
FIG. 5 is a sectional view taken on the line 5—5 in FIG. 2, showing the cells for holding stacks of siding panels.

The ends of each strap 90 are secured to one of the cross rods 92. The laterally spaced vertically extending side portions of each strap extend downwardly from the cross bar and are connected by four vertically spaced cell-supporting, horizontal cross strap portions 95, 96, 98 and 100. The cell at the top of each stack is supported by the cross strap portions 95, the next lower cell is supported by the cross strap portions 96, the next lower cell is supported by the cross strap portions 98 and the bottom cell in each stack is supported by the cross strap portions 100. Although FIG. 5 shows the cross strap portions as single ply, they are preferably double ply as shown in FIG. 6. As further shown in FIG. 6, the cross strap portions 95, 96 and 98 of each strap preferably are reinforced by a strip of plastic or aluminum 101 between the piles because they may have to support some or all of the weight of the panels P loaded in cells thereabove without sagging, thus insuring that the panels will be straight when delivered. It has not been found necessary to reinforce the lower cross strap portion 100 because the lower strap portion usually rests on the bottom or base of the container and therefore does not require reinforcement.

The two end posts 54, 64 at one end of the container have doors 110 secured thereto by hinges 112 so that the doors may be swung on vertical axes towards one another to close that end of the container or away from one another to open positions along the sides of the container for loading or unloading siding panels into or from the cells. The two end posts 60, 70 at the opposite end of the container may also have doors 110 hinged for the same swinging movement between open and closed positions, if desired. The doors at each end of the container may have a mechanical latching mechanism 114 which is attached to the doors to secure the doors in closed position.

Figure 3:
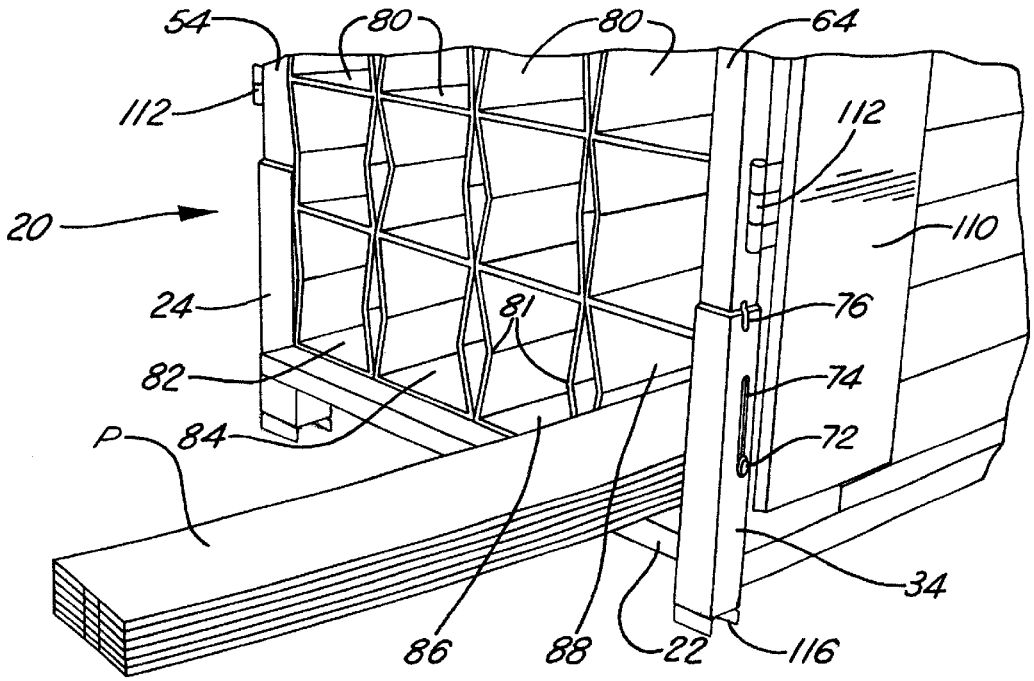
FIG. 3 is a fragmentary perspective view showing siding panels being loaded into one of the cells of the container.
Figure 4:
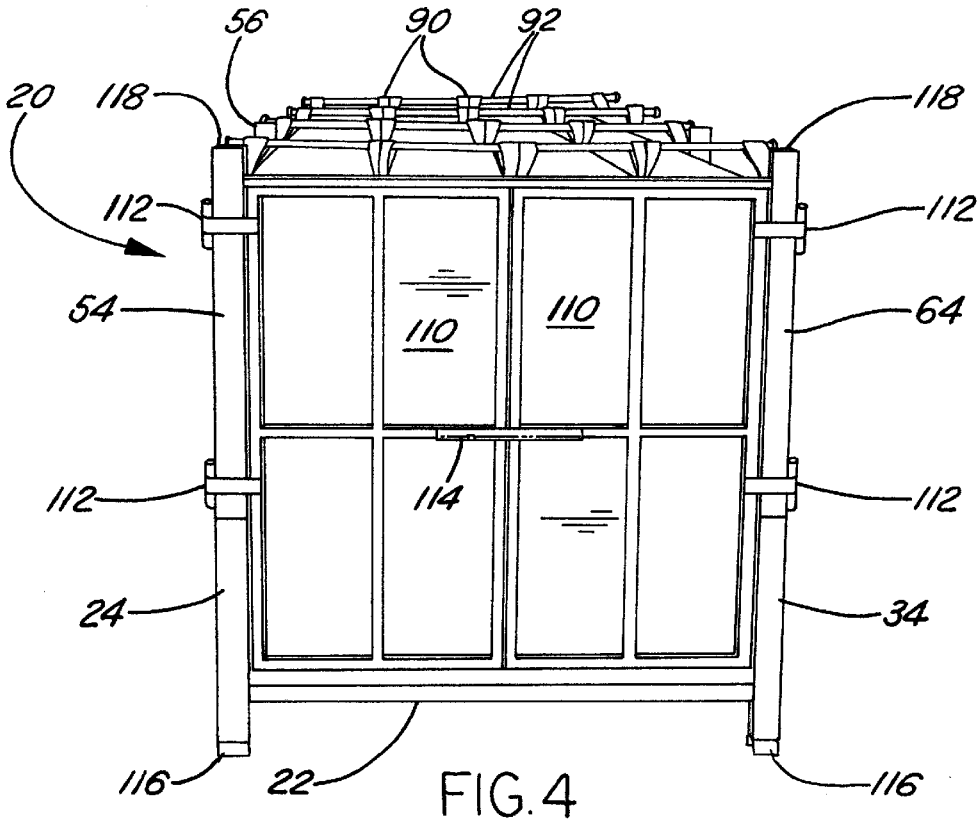
FIG. 4 is a front view of the container showing the front doors closed.

The siding panels P if made of vinyl are usually extruded. The container 20 may be placed at the outlet of an extruder so that panels from the extruder may be loaded directly into the cells of the container as shown in FIG. 3. After all of the cells have been loaded with vinyl siding, the doors at both ends of the container may be closed and the container is ready to be shipped to a desired destination.

Figure 7:
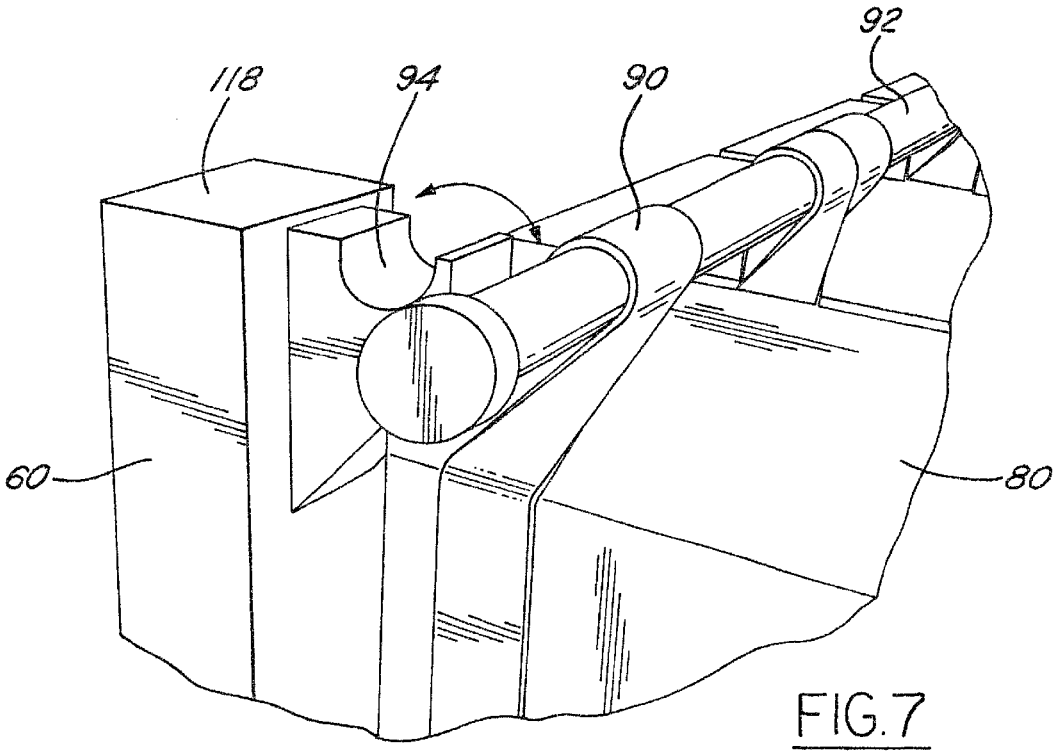
FIG. 7 is a fragmentary perspective view at a top corner of the container.

At the four corners of base 22 are downwardly extending nesting feet, sometimes referred to as targets or cups 116, in the form of inverted channels, which interlock with the tops of posts 54, 60, 64, and 70 to facilitate double stacking of two or more containers in both the erected and collapsed positions (see FIGS. 7 and 11). The tops of the posts are vertically aligned with the respective targets or cups 116. Along the base 22 of the container are brackets 117 to receive straps (not shown) for tying down a stacked upper container on a lower container.

Figure 8:
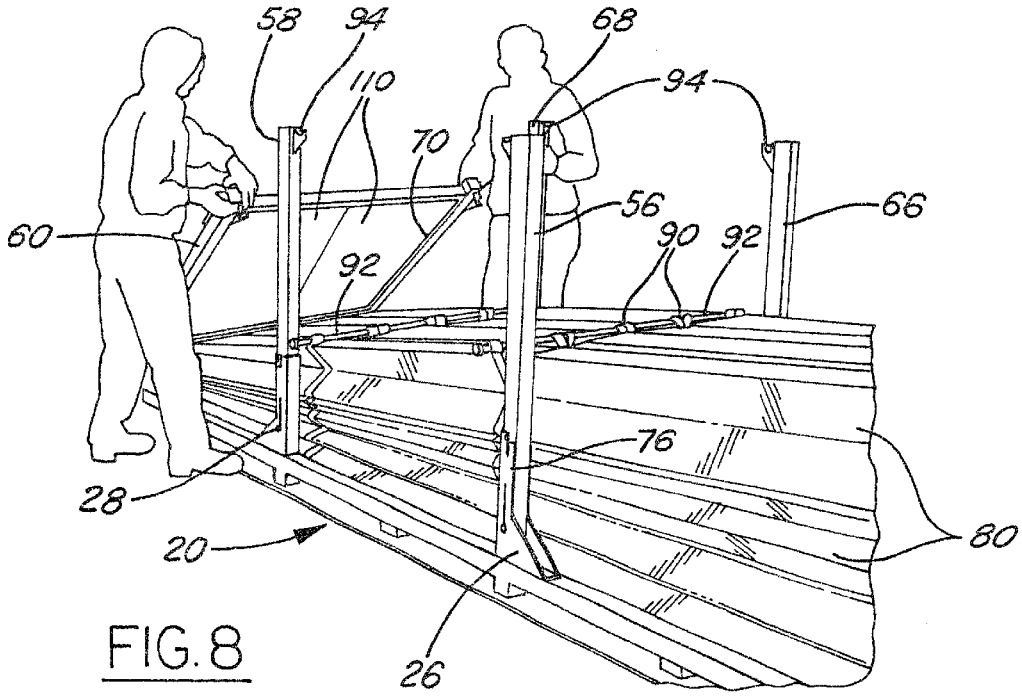
FIGS. 8 and 9 are perspective views showing the container in the process of being collapsed.
Figure 9:
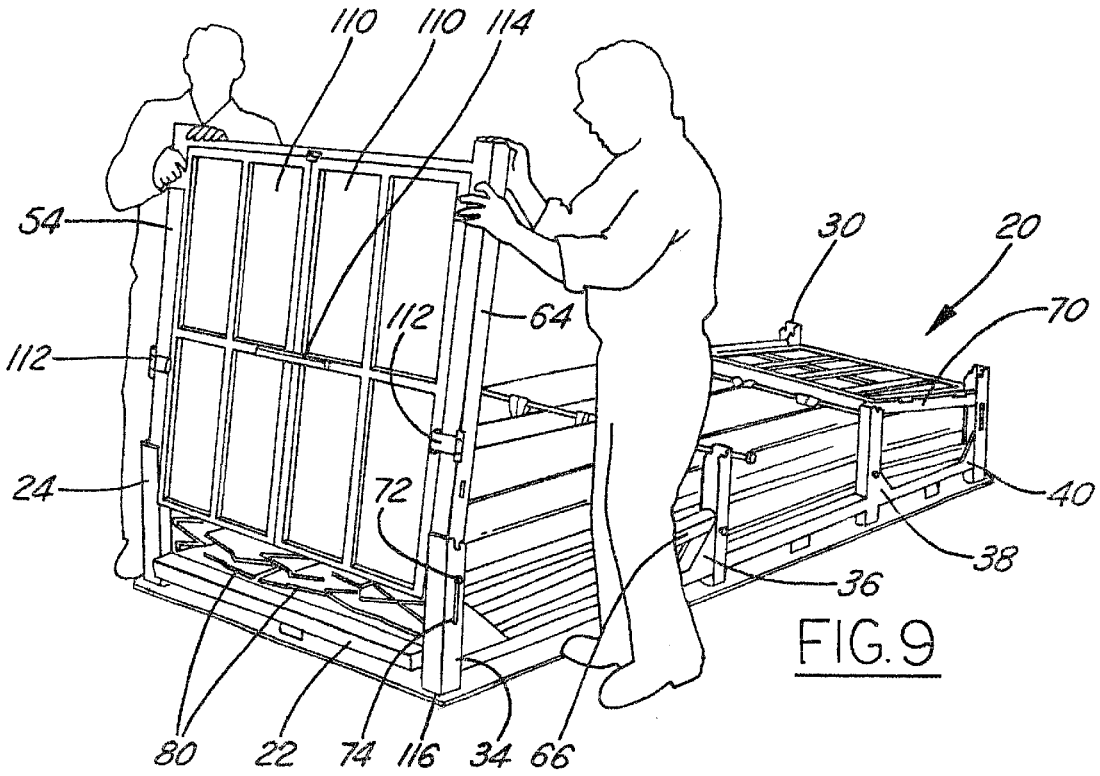
Figure 10:
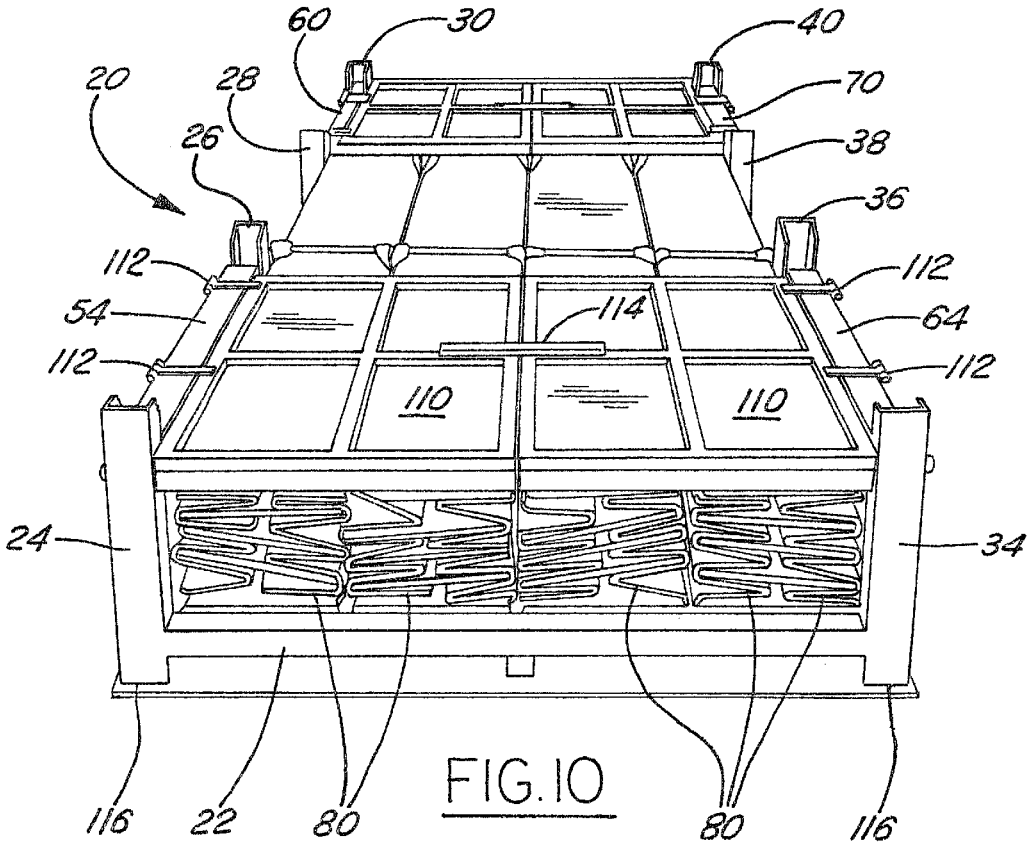
FIG. 10 is a front perspective view of the collapsed container.

After all of the siding panels have been unloaded from the container, the container may be collapsed as shown in FIGS. 8–10. The cross rods 92 are removed from the posts, allowing the cells 80 to collapse by inward folding of the living hinges 81 of the cell side walls. The combined height of the cells is thus greatly reduced. The end post assemblies including the posts 54, 64 and 60, 70 containing the doors 110 followed by the intermediate posts 56, 58, 66 and 68 are then pivoted to horizontal positions as shown so that the container takes up a minimum amount of space for return to the manufacturing plant for reloading with siding panels. The collapsed horizontal end posts and attached doors and the intermediate posts rest on the collapsed cells 80.

Figure 14:
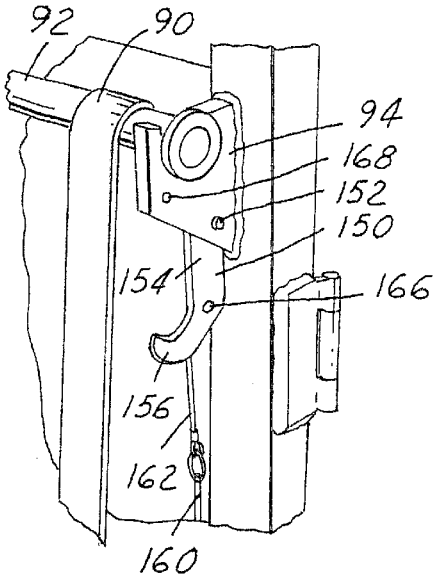
FIGS. 14 and 15 are fragmentary perspective views showing a modification of one of the brackets for supporting a cross rod.
Figure 15:
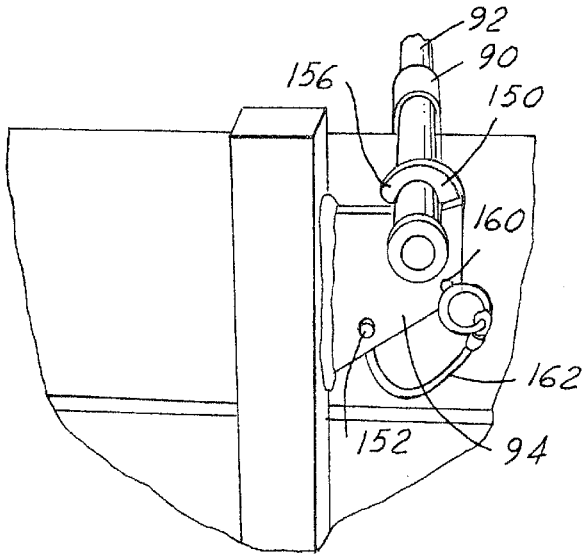
Figure 16:
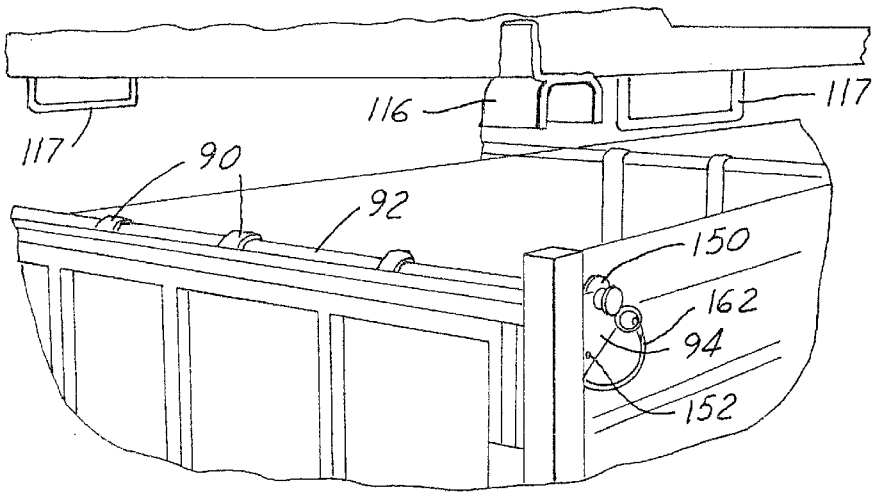
FIG. 16 is a fragmentary perspective view showing an upper container in the process of being stacked on a lower container, and also showing the modification of FIGS. 14 and 15.

FIGS. 14–16 show a modification in which each of the brackets 94 previously described has a latch 150 pivoted thereto by a pivot pin 152. The latch is generally J-shaped, having an elongated body portion 154 and a hook 156 at one end. The latch 150 is adapted to pivot from the open position shown in FIG. 14 to the closed position shown in FIG. 15. In the closed position of FIG. 15, the hook 154 extends over the top of the groove in the bracket 94 to capture a rod seated in the groove and prevent the rod from accidently popping out of the groove. The latch is held in the closed position of FIG. 15 by a pin 160 attached to the end of a tether 162, the tether being attached at the opposite end to the bracket. The pin 160 is adapted to extend through a hole 166 in the body portion 154 of the latch and through a hole 168 in the bracket 94 when the latch is in the closed position of FIG. 15. To remove a rod from a bracket groove or to place a rod in a bracket groove, the pin 160 is withdrawn and the latch 150 is manually swung to the FIG. 14 position.

What is claimed is:

1. A container for bulk material such as siding panels, comprising;

an elongated base, support means arranged along opposite sides of said base and extending upwardly from said base, a plurality of open-ended, tubular cells extending lengthwise of said base between said support means for receiving and supporting the bulk material, cross rods supported by said support means, and means suspended from said cross rods for supporting said cells.

2. A container for bulk material such as siding panels, comprising;

an elongated base, a plurality of posts, means supporting said posts on said base in generally upright positions and in spaced relation to one another along opposite sides of said base, said posts being disposed in laterally spaced pairs with the posts of each pair on the opposite sides of the base, a plurality of open-ended, tubular cells extending lengthwise of said base between the posts of each pair for receiving and supporting the bulk material, a cross rod supported by the posts of each pair of posts, and means suspended from said cross rods for supporting said cells.

3. A container as defined in claim 2, wherein said cells are arranged in a plurality of laterally juxtaposed stacks with a plurality of said cells in each of said stacks.

4. A container as defined in claim 3, wherein said means supporting said posts comprises a stanchion for each of said posts, said stanchions supporting said posts for movement from their generally upright positions to collapsed positions.

5. A container as defined in claim 3, wherein said means supporting said posts comprises a stanchion for each of said posts, said stanchions having means supporting said posts for pivotal movement from their generally upright positions to generally horizontal collapsed positions.

6. A container as defined in claim 3, wherein said means for supporting said stacks of cells comprises a plurality of flexible hanger straps.

7. A container as defined in claim 6, wherein each of said hanger straps has laterally spaced vertical side portions extending downwardly from said rod, each of said hanger straps also having vertically spaced horizontal cross strap portions connecting said side portions, said cross strap portions of each of said hanger straps supporting the cells of one of the stack of cells.

8. A container as defined in claim 3, wherein said cells are flexible and collapsible when empty.

9. A container as defined in claim 3, wherein each of said cells has side walls provided with foldable hinges enabling collapse of said cells when empty.

10. A container as defined in claim 9, wherein said cells are made of plastic material and said hinges are living hinges.

11. A container for bulk material such as siding panels, comprising;

an elongated base, a plurality of posts, means supporting said posts on said base in generally upright positions and in spaced relation to one another along opposite sides of said base, said posts being disposed in laterally spaced pairs with the posts of each pair on the opposite sides of the base, a plurality of open-ended, tubular cells extending lengthwise of said base between the posts of each pair for receiving and supporting the bulk material, said cells being arranged in a plurality of laterally juxtaposed stacks with a plurality of said cells in each of said stacks, a cross rod supported by the posts of each pair of posts, and means suspended from said cross rods for supporting each of said stacks of cells, said means supporting said posts comprising a stanchion for each of said posts, said stanchions having means supporting said posts for pivotal movement from their generally upright positions to generally horizontal collapsed positions, said means for supporting said stacks of cells comprising a plurality of hanger straps, each of said cells being flexible and collapsible when empty.

12. A container as defined in claim 11, wherein each of said hanger straps has laterally spaced vertical side portions extending downwardly from said rod, each of said hanger straps also has vertically spaced horizontal cross strap portions connecting said side portions, said cross strap portions of each of said hanger straps supporting the cells of one of the stack of cells.

13. A container as defined in claim 12, wherein each of said cells is made of plastic material and has side walls provided with living hinges enabling the collapse of said cells.

14. A container as defined in claim 13, wherein the cross rods are supported by the posts in brackets each having an upwardly opening groove providing a receptacle to receive and support one of the cross rods, and a latch pivoted to each of the brackets swingable from a first position closing said groove to retain one of the cross rods therein to a second position opening said groove to permit the cross rod to be removed therefrom.

15. A container as defined in claim 14, further including doors for opening and closing one end of said container.

16. A container as defined in claim 14, further including doors for opening and closing opposite ends of said container, and means pivotally mounting said doors on selected ones of said posts.

17. A container as defined in claim 16, further including means enabling stacking said container on another container of the same construction.

18. A container as defined in claim 17, wherein said means enabling stacking comprises feet downwardly projecting downwardly from said base and adapted to nest with the tops of selecting ones of said posts, said posts being vertically aligned with the respective feet.

* * * * *